US009747826B2

(12) United States Patent
Lee et al.

(10) Patent No.: US 9,747,826 B2
(45) Date of Patent: Aug. 29, 2017

(54) METHOD OF OPERATING DISPLAY DEVICE TO ADJUST LUMINANCE BASED ON PANEL REFRESH COMMAND

(71) Applicant: SAMSUNG DISPLAY CO., LTD., Yongin, Gyeonggi-Do (KR)

(72) Inventors: Jong-Jin Lee, Yongin-si (KR); Jin-Kyu Park, Seoul (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 103 days.

(21) Appl. No.: 14/725,613

(22) Filed: May 29, 2015

(65) Prior Publication Data

US 2016/0117995 A1 Apr. 28, 2016

(30) Foreign Application Priority Data

Oct. 24, 2014 (KR) ..... 10-2014-0145414

(51) Int. Cl.
*G09G 3/20* (2006.01)

(52) U.S. Cl.
CPC ..... *G09G 3/20* (2013.01); *G09G 2320/0247* (2013.01); *G09G 2320/0626* (2013.01); *G09G 2330/021* (2013.01)

(58) Field of Classification Search
None
See application file for complete search history.

(56) References Cited

U.S. PATENT DOCUMENTS

2004/0189583 A1* 9/2004 Park ..... G09G 3/3677 345/100
2009/0160845 A1* 6/2009 Jang ..... G09G 3/3677 345/214
2012/0075188 A1* 3/2012 Kwa ..... G09G 3/2096 345/168
2012/0146968 A1 6/2012 Glen
2012/0147020 A1* 6/2012 Hussain ..... G06T 1/00 345/522

(Continued)

FOREIGN PATENT DOCUMENTS

KR 1020060018393 3/2006
KR 1020110054775 5/2011
KR 1020130045608 5/2013

*Primary Examiner* — Chad Dicke
(74) *Attorney, Agent, or Firm* — F. Chau & Associates, LLC

(57) ABSTRACT

A method of operating a display device includes operating a timing controller in a normal mode. The timing controller generates a driving signal of a display panel in response to input data signal in the normal mode. The method includes operating the timing controller in a panel self-refresh mode. The timing controller generates the driving signal based on stop image data stored in a frame buffer in response to a first panel self-refresh start command in the panel self-refresh mode. The method includes inputting a second panel self-refresh start command to the timing controller during a synchronization procedure. The timing controller changes an operation mode from the panel self-refresh mode to the normal mode in response to a panel self-refresh end command in the synchronization procedure. The method includes controlling luminance of the display panel, by the timing controller, based on a length of a first vertical blank period.

20 Claims, 10 Drawing Sheets

(56) References Cited

U.S. PATENT DOCUMENTS

2012/0262627 A1* 10/2012 Cho ..... G09G 5/006
348/540
2013/0038621 A1* 2/2013 Choi ..... G09G 3/2092
345/589

* cited by examiner

METHOD OF OPERATING DISPLAY DEVICE TO ADJUST LUMINANCE BASED ON PANEL REFRESH COMMAND

CROSS-REFERENCE TO RELATED APPLICATIONS

This application claims priority under 35 U.S.C. §119 to Korean Patent Application No. 10-2014-0145414, filed on Oct. 24, 2014, the disclosure of which is incorporated by reference in its entirety herein.

BACKGROUND

1. Technical Field

Exemplary embodiments of the inventive concept relate to a display device. More particularly, exemplary embodiments of the inventive concept relate to a method of operating a display device with reduced flicker.

2. Discussion of Related Art

A smart phone or mobile phone may include a high resolution display device. The high resolution display device receives an image signal from a host through a display drive integrated chip (IC) to display the image signal. When a portable display device as described above receives a still image from the host, power consumption occurs in a memory access and an interface of the host used to display the still image.

Recently, the Video Electronics Standard Association (VESA) has announced a new version of an embedded display port ('eDP') standard. The eDP standard is an interface standard for devices equipped with a display such as a lap-top computer, a tablet personal computer (PC), a net book, and an all-in-one desktop PC. Particularly, eDP v 1.3 includes a panel self-refresh ('PSR') technology.

The PSR technology may improve a power saving function in a system and extend a life span of a battery in a portable PC environment. The PSR technology may display an image while minimizing power consumption using a memory installed in a display, thereby significantly increasing a usable time of a battery in a portable PC environment.

However, screen flickering may occur during a change between a normal mode and a panel self-refresh mode. Further, the screen flickering may deteriorate the quality of the image displayed.

SUMMARY

At least one exemplary embodiment of the inventive concept provides a method of operating a display device with reduced flicker.

According to an exemplary embodiment of the inventive concept, a method of operating a display device includes operating a timing controller in a normal mode. The timing controller generates a driving signal of a display panel in response to an input data signal in the normal mode. The method includes operating the timing controller in a panel self-refresh mode. The timing controller generates the driving signal based on a stop image data stored in a frame buffer in response to a first panel self-refresh start command in the panel self-refresh mode. The method includes inputting a second panel self-refresh start command to the timing controller during a synchronization procedure. The timing controller changes an operation mode from the panel self-refresh mode to the normal mode in response to a panel self-refresh end command in the synchronization procedure. The method includes a controlling a luminance of the display panel, by the timing controller, based on a length of a first vertical blank period between a first time point to a second time point. The second panel self-refresh start command is inputted to the memory controller at the first time point. The synchronization procedure ends at the second time point.

In an exemplary embodiment, controlling the luminance of the display panel may include generating the driving signal, by the timing controller, in a first frame display period in response to the input data signal when the length of the first vertical blank period is larger than a length of a display period per frame in the synchronization procedure. The first vertical blank period may be divided into the first frame display period and a remaining vertical blank period. The first frame display period may have the same length as the display period per frame in the synchronization procedure.

In an exemplary embodiment, controlling the luminance of the display panel may further include a changing, by the timing controller, a length of the remaining vertical blank period to an average value of length of a vertical blank period per frame in the synchronization procedure and the length of the first vertical blank period when the length of the first vertical blank period is larger than the length of the display period per frame in the synchronization procedure.

In an exemplary embodiment, controlling the luminance of the display panel may include maintaining, by the timing controller, the luminance of the display panel by maintaining the length of the first vertical blank period when the length of the first vertical blank period is equal to or less than length of a display period per frame in the synchronization procedure.

In an exemplary embodiment, controlling the luminance of the display panel may include a changing, by the timing controller, the length of the first vertical blank period to an average value of a length of a vertical blank period per frame in the synchronization procedure and a length of a vertical blank period per frame in the panel self-refresh mode when the length of the first vertical block period is equal to or less than length of a display period per frame in the synchronization procedure In an exemplary embodiment, operating the timing controller in the panel self-refresh mode may include storing an image data of a frame, which is a first frame after the first panel self-refresh start command is inputted, as the stop image data to the frame buffer and a generating the driving signal based on the stop image data stored in the frame buffer.

In an exemplary embodiment, the timing controller may include a receiver. The receiver may include a command receiver and a data receiver. The command receiver may receive the first and second panel self-refresh start commands and the panel self-refresh end command as a command signal. The data receiver may receive the input data signal.

In an exemplary embodiment, an application processor may generate the first and second panel self-refresh start commands, the panel self-refresh end command, and the input data signal.

In an exemplary embodiment, the timing controller may include a mode register storing a first value corresponding to the normal mode or a second value corresponding to the panel self-refresh mode.

In an exemplary embodiment, the timing controller may set a value stored in the mode register as the first value in an initialization process.

In an exemplary embodiment, the timing controller may set a value stored in the mode register as the second value in response to the first or second panel self-refresh start command.

In an exemplary embodiment, the timing controller may set a value stored in the mode register as the first value in response to the panel self-refresh end command.

In an exemplary embodiment, the timing controller may include a clock signal generator configured to generate a clock signal. The clock signal generator may generate the clock signal based on the input data signal when a value stored in the mode register is the first value. The clock signal generator may generate the clock signal based on an output signal of an oscillator when the value stored in the mode register is the second value.

In an exemplary embodiment, the timing controller may provide power to the data receiver when the value stored in the mode register is the first value.

In an exemplary embodiment, the timing controller may cut power to the data receiver when the value stored in the mode register is the second value.

According to an exemplary embodiment of the inventive concept, a method of operating a display device includes: a timing controller of the display device comparing a vertical blank period to a display period after receiving a first command to end a panel self-refresh mode followed by a second command to start the panel self-refresh mode; the timing controller reducing the vertical blank period when a result of the comparing indicates the vertical blank period is greater than the display period; and the timing controller maintaining the vertical blank period when the result indicates the vertical blank period is less than or equal to the display period. In an embodiment, the second command is received at a first time point, the timing controller performs a synchronization procedure that begins on receipt of the first command and ends at a second time point after the first time point, and the compared vertical blank period is between the first and second time points. In an embodiment, the reducing divides the vertical blank period into a frame display period and a remaining vertical blank period. In an embodiment, the reducing generates a vertical synchronizing signal during the frame display period that toggles from a first logic state to a second logic state and that has the first logic state during the remaining vertical blank period. In an exemplary embodiment, the reducing generates a vertical synchronizing signal during the frame display period that toggles from a first logic state to a second logic state and that has the first logic state during the remaining vertical blank period.

A display device according to at least one embodiment of the inventive concept may reduce flicker by changing a length of an additional vertical block period which is generated when an operation mode of the timing controller is changed again to a panel self-refresh mode during a synchronization procedure in which the operation mode of the timing controller is changed from the panel self-refresh mode to a normal mode.

BRIEF DESCRIPTION OF THE DRAWINGS

The inventive concept will become more apparent by describing exemplary embodiments thereof with reference to the accompanying drawings, in which.

DETAILED DESCRIPTION

The inventive concept will be described more fully hereinafter with reference to the accompanying drawings, in which various exemplary embodiments are shown. As will be appreciated by one skilled in the art, aspects of the present disclosure may be embodied as a system, a method, or a computer program product. Accordingly, aspects of the present disclosure may take the form of an entirely hardware embodiment, an entirely software embodiment (including firmware, resistant software, micro-code, etc.), or an embodiment combining software and hardware aspects that may all generally be referred to herein as a "circuit", "module", or "system". Furthermore, aspects of the present disclosure may take the form of a computer program product embodied in one or more computer readable medium(s) having computer readable program code embodied thereon.

Figure 1:
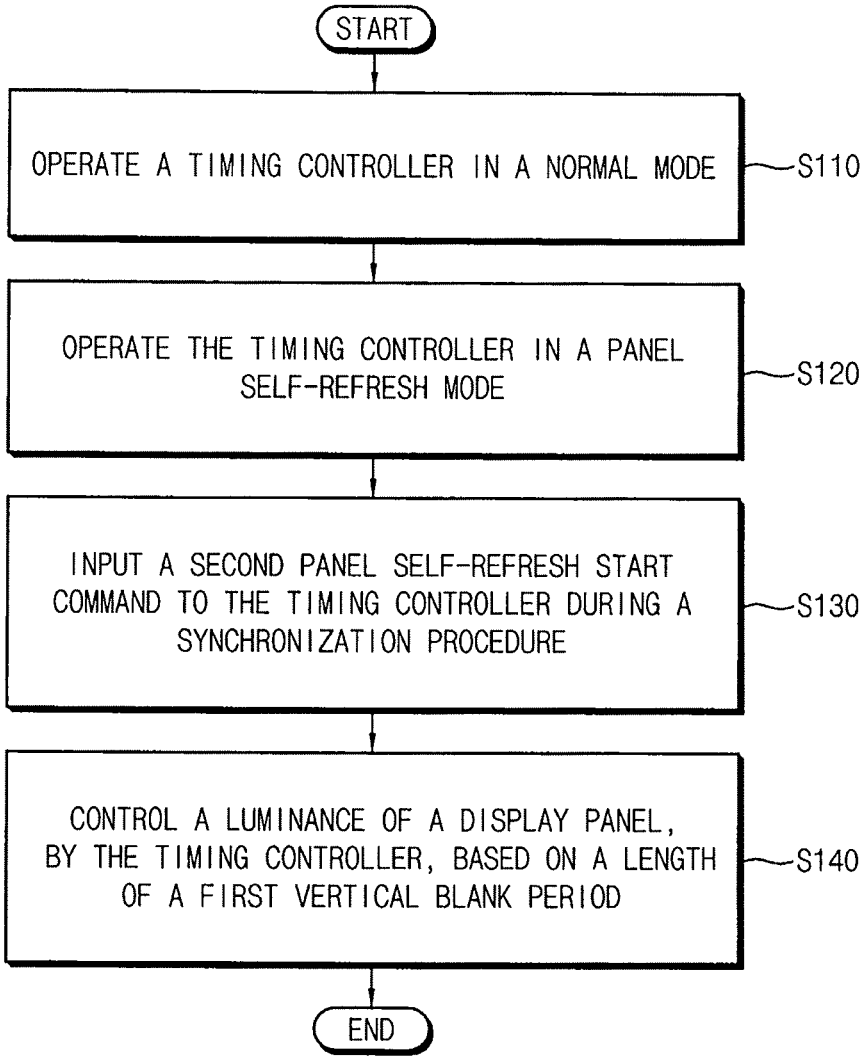
FIG. 1 is a flow chart illustrating a method of operating a display device according to an exemplary embodiment of the inventive concept.

FIG. 1 is a flow chart illustrating a method of operating a display device according to an exemplary embodiment of the inventive concept.

Referring to FIG. 1, a method of operating a display device includes operating a timing controller in a normal mode (S110). The timing controller generates a driving signal for a display panel in response to an input data signal in the normal mode. The method includes operating the timing controller in a panel self-refresh mode (S120). For example, the method switches the mode from the normal mode to the panel self-refresh mode. The timing controller generates the driving signal based on stop image data stored in a frame buffer in response to a first panel self-refresh start command received during the panel self-refresh mode. In an exemplary embodiment, stop image data is a frame of image data that is continuously displayed during a panel self-refresh mode. The method includes inputting a second panel self-refresh start command to the timing controller during a synchronization procedure (S130). The synchronization procedure may be performed when switching between the normal mode and the panel self-refresh mode. The timing controller changes an operation mode from the panel self-refresh mode to the normal mode in response to a panel self-refresh end command in the synchronization procedure. The method includes controlling a luminance of the display panel, by the timing controller, based on a length of a first vertical blank period between a first time point to a second time point (S140). For example, the method can adjust the length of the vertical blank period, and these adjustments in turn may have an observable effect on the luminance of the display. The second panel self-refresh start command is inputted to the memory controller at the first time point. The synchronization procedure ends at the second time point.

Figure 2:
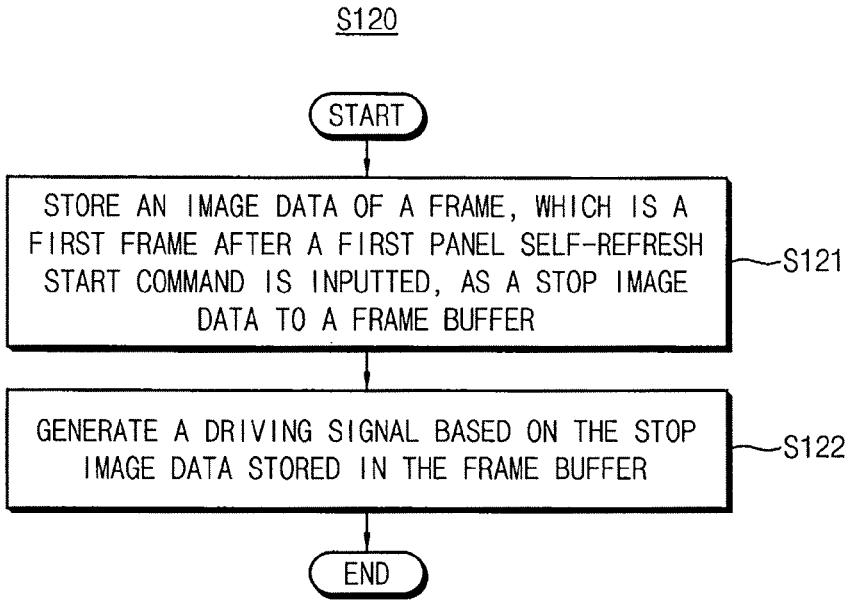
FIG. 2 is a flow chart illustrating operating the timing controller in the panel self-refresh mode included in the flow chart of FIG. 1.

FIG. 2 is a flow chart illustrating operating the timing controller in the panel self-refresh mode included in the flow chart of FIG. 1 according to an exemplary embodiment of the inventive concept.

Referring to FIG. 2, in an exemplary embodiment, operating the timing controller in the panel self-refresh mode (S120) includes storing image data of a frame, which is a first frame after the first panel self-refresh start command is inputted, as the stop image data to the frame buffer (S121) and a generating the driving signal based on the stop image data stored in the frame buffer (S122).

The steps (S121 and S122) will be described with the references to FIGS. 6 and 7.

Figure 3:
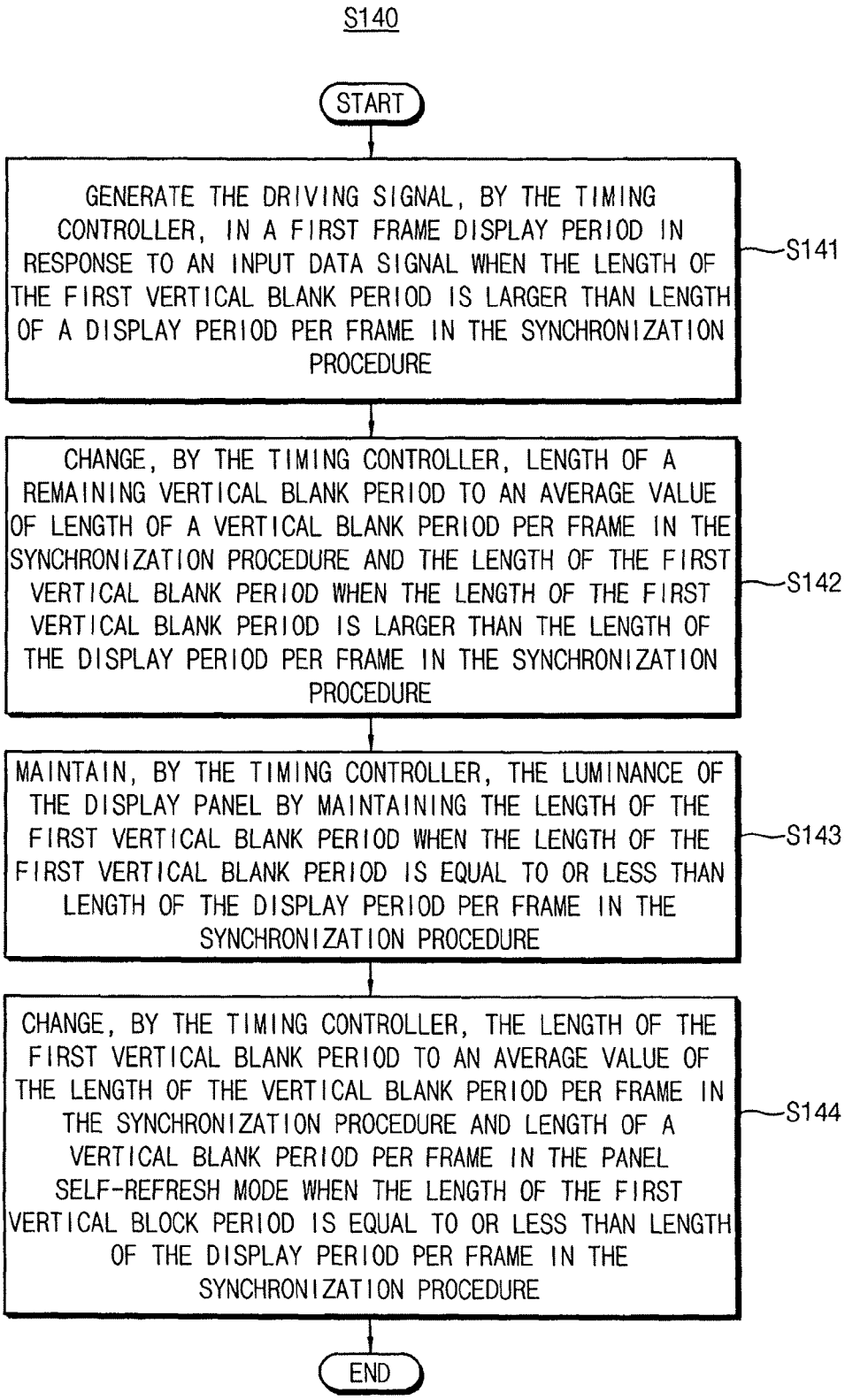
FIG. 3 is a flow chart illustrating controlling the luminance of the display panel, by the timing controller, based on the length of a first vertical blank period between a first time point and a second time point included in the flow chart of FIG. 1.

FIG. 3 is a flow chart illustrating controlling the luminance of the display panel, by the timing controller, based on the length of the first vertical blank period between the first time point and the second time point included in the flow chart of FIG. 1.

Referring to FIG. 3, in an exemplary embodiment, controlling the luminance of the display panel (S140) includes generating the driving signal, by the timing controller, in a first frame display period in response to the input data signal when the length of the first vertical blank period is larger than a length of a display period per frame in the synchronization procedure (S141). The first vertical blank period may be divided into the first frame display period and a remaining vertical blank period. The first frame display period may have the same length as the display period per frame in the synchronization procedure.

In an exemplary embodiment, controlling the luminance of the display panel (S140) includes changing, by the timing controller, a length of the remaining vertical blank period to an average value of a length of a vertical blank period per frame in the synchronization procedure and the length of the first vertical blank period when the length of the first vertical blank period is larger than the length of the display period per frame in the synchronization procedure (S142).

In an exemplary embodiment, controlling the luminance of the display panel (S140) includes maintaining, by the timing controller, the luminance of the display panel by maintaining the length of the first vertical blank period when the length of the first vertical blank period is equal to or less than length of the display period per frame in the synchronization procedure (S143).

In an exemplary embodiment, controlling the luminance of the display panel (S140) includes changing, by the timing controller, the length of the first vertical blank period to an average value of the length of the vertical blank period per frame in the synchronization procedure and a length of a vertical blank period per frame in the panel self-refresh mode when the length of the first vertical block period is equal to or less than length of the display period per frame in the synchronization procedure (S144).

The steps (S141 through S144) will be described with the references to FIGS. 7 through 10.

Figure 4:
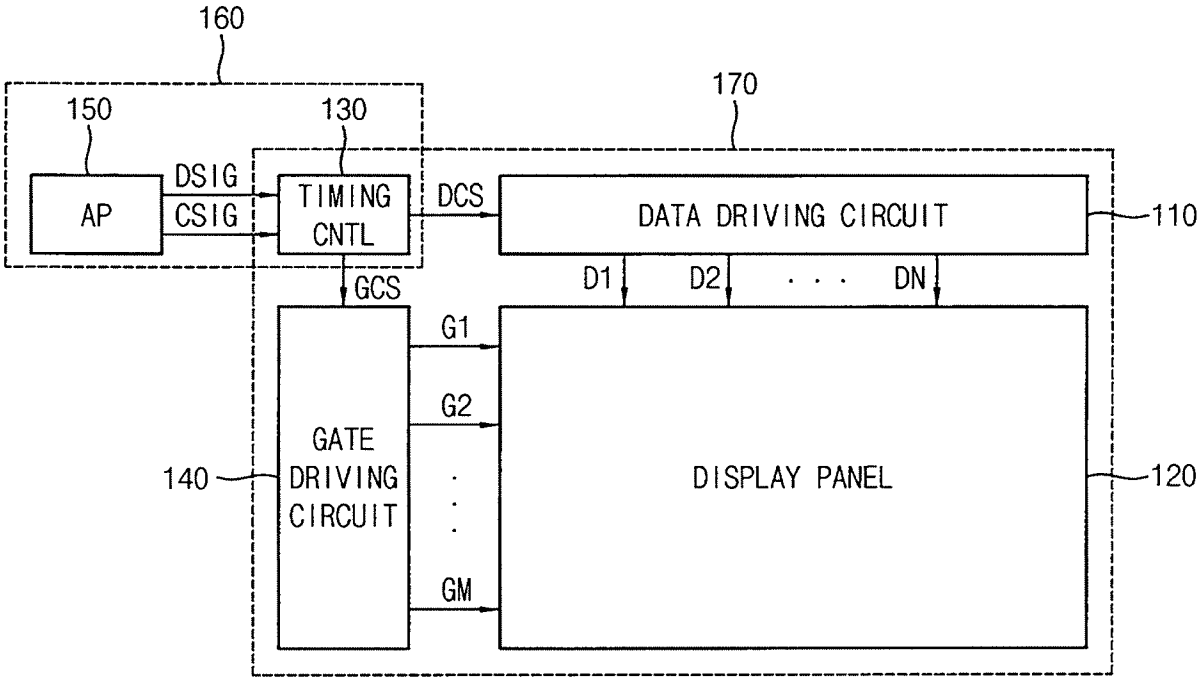
FIG. 4 is a block diagram illustrating a display system according to an exemplary embodiment of the inventive concept.

FIG. 4 is a block diagram illustrating a display system according to an exemplary embodiment of the inventive concept.

Referring to FIG. 4, a display system 100 includes an application processor AP 150, a display panel 120, a timing controller TIMING CNTL 130, a gate driving circuit GATE DRIVING CIRCUIT 140, and a data driving circuit DATA DRIVING CIRCUIT 110. The display device 170 includes the display panel 120, the timing controller 130, the gate driving circuit 140, and the data driving circuit 110. A transmitting/receiving circuit 160 may include the application processor AP 150 and the timing controller TIMING CNTL 130. The transmitting/receiving circuit 160 may be embodied by a transceiver.

The display panel 120 includes a plurality of pixels. The timing controller 130 generates a data driving circuit control signal DCS and a gate driving circuit control signal GCS based on an input data signal DSIG and a command signal CSIG inputted from the application processor 150. The input data signal DSIG and the command signal CSIG may be transmitted wirelessly from the application processor 150 to the timing controller TIMING CNTL 130. The gate driving circuit 140 generates a plurality of gate signals based on the gate driving circuit control signal GCS, and provides the plurality of gate signals to the plurality of pixels through a plurality of gate signal lines G1, G2 through GM. The data driving circuit 110 generates a plurality of data signals based on the data driving circuit control signal DCS, and provides the plurality of data signals to the plurality of the pixels through a plurality of data signal lines D1, D2 through DN.

The transmitting/receiving circuit 160 will be described with the reference to FIG. 5.

Figure 5:
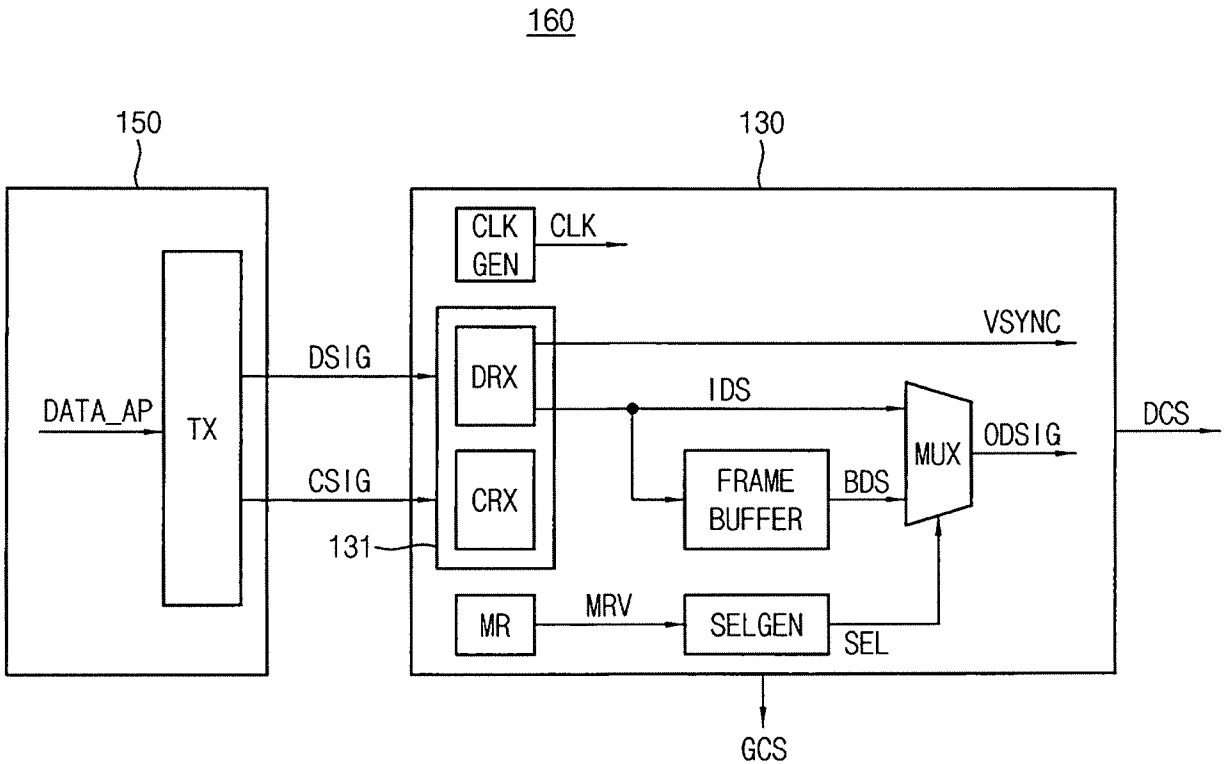
FIG. 5 is a block diagram illustrating a transmitting/receiving circuit included in the display system of FIG. 4 according to an exemplary embodiment of the inventive concept.

FIG. 5 is a block diagram illustrating a transmitting/receiving circuit included in the display system of FIG. 4 according to an exemplary embodiment of the inventive concept.

Referring to FIG. 5, the application processor 150 includes a transmitter TX. The timing controller 130 includes a receiver 131, a clock signal generator CLKGEN, a mode register MR, a frame buffer FRAME BUFFER, a selection signal generator SELGEN, and a multiplexer MUX. The receiver 131 includes a command receiver CRX and a data receiver DRX.

The transmitter TX may generate the input data signal DSIG and the command signal CSIG based on an application processor internal data DATA_AP. In an exemplary embodiment, the transmitter TX generates the input data signal DSIG and the command signal CSIG according to an eDP standard. The command receiver CRX may receive a panel self-refresh start command and a panel self-refresh end command as the command signal CSIG. The data receiver DRX may receive the input data signal DSIG.

The timing controller 130 may use a value MRV stored in the mode register MR as the first value in an initialization process. The timing controller 130 may use a value MRV stored in the mode register MR as the second value in response to the panel self-refresh start command. The timing controller 130 may use a value MRV stored in the mode register MR as the first value in response to the panel self-refresh end command.

The clock signal generator CLKGEN may generate the clock signal CLK based on the input data signal DSIG when a value MRV stored in the mode register MR is the first value. The clock signal generator CLKGEN may generate the clock signal CLK based on an output signal of an oscillator included in the timing controller 130 when the value MRV stored in the mode register MR is the second value. In an exemplary embodiment, the oscillator is an electronic circuit that produces a periodic, oscillating electronic signal (e.g., a sine wave, a square wave, etc.).

The receiver 131 may generate an internal data signal IDS and a vertical synchronization signal VSYNC based on the input data signal DSIG, the command signal CSIG, and the value MRV stored in the mode register MR. The frame buffer FRAME BUFFER may store the internal data signal IDS as a stop image data, and output the stop image data as a buffer data signal BDS.

The selection signal generator SELGEN may generate a selection signal SEL based on the value MRV stored in the mode register MR. The multiplexer MUX may output the internal data signal IDS or the buffer data signal BDS as an output data signal ODSIG based on the selection signal SEL. The timing controller 130 may generate the data driving circuit control signal DCS and the gate driving circuit control signal GCS based on the vertical synchronization signal VSYNC and the output data signal ODSIG.

In an exemplary embodiment, the timing controller 130 provides power to the data receiver DRX when the value MRV stored in the mode register MR is the first value. In an exemplary embodiment, the timing controller 130 cuts power to the data receiver DRX when the value MRV stored in the mode register MR is the second value. The timing controller 130 may operate with lower power by cutting power to the data receiver DRX when the timing controller 130 operates in the panel self-refresh mode.

FIGS. 6 through 9 are timing diagrams illustrating exemplary embodiments of operations of the transmitting/receiving circuit of FIG. 5. In an exemplary embodiment, the first value is a logic high value and the second value is a logic low value. In another exemplary embodiment, the first value is a logic low value and the second value is a logic high value. FIGS. 6 through 10 show the case where the first value is a logic low value and the second value is a logic high value.

Figure 6:
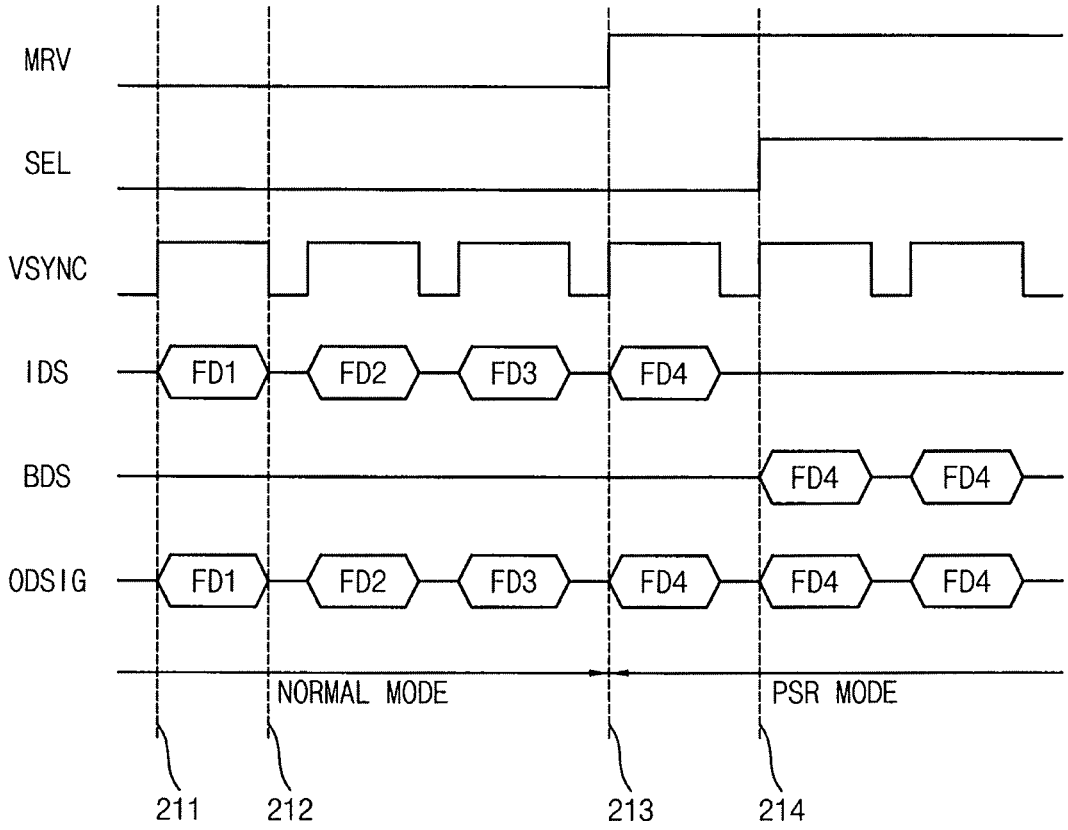
FIGS. 6 through 9 are timing diagrams illustrating example embodiments of operations of the transmitting/receiving circuit of FIG. 5.

FIG. 6 shows a case where the operation mode of the timing controller 130 is changed from the normal mode NORMAL MODE to the panel self-refresh mode PSR MODE.

From a first time point 211 to a second time point 212, because the value MRV stored in the mode register MR is a logic low value, the timing controller 130 operates in the normal mode NORMAL MODE. From the first time point 211 to the second time point 212, the receiver 131 activates the vertical synchronization signal VSYNC, the receiver 131 generates a first frame data FD1 as the internal data signal IDS, and the multiplexer MUX outputs the internal data signal IDS as the output data signal ODSIG. A second frame data FD2 and a third frame data FD3 may be understood based on the description about the first frame data FD1.

Because the value MRV stored in the mode register MR is changed to a logic high value in response to the panel self-refresh start signal inputted to the timing controller 130 at a third time point 213, the timing controller 130 operates in the panel self-refresh mode PSR MODE after the third time point 213. From the third time point 213 to a fourth time point 214, the receiver 131 generates a fourth frame data FD4 as the internal data signal IDS, and the multiplexer MUX outputs the internal data signal IDS as the output data signal ODSIG. At the same time, the frame buffer FRAME BUFFER stores the fourth frame data FD4 through the internal data signal IDS. At the fourth time point 214, the selection signal generator SELGEN activates the selection signal SEL based on the value MRV stored in the mode register MR. The frame buffer FRAME BUFFER outputs the fourth frame data FD4 as the buffer data signal BDS and the multiplexer MUX outputs the buffer data signal BDS as the output data signal ODSIG. The multiplexer MUX continues to output the fourth frame data periodically until the timing controller 130 switches to a different mode. For example, the multiplexer MUX may output the fourth frame data FD4 each time a period of the vertical synchronization signal VSYNC elapses until the timing controller 130 switches to the different mode.

Figure 7:
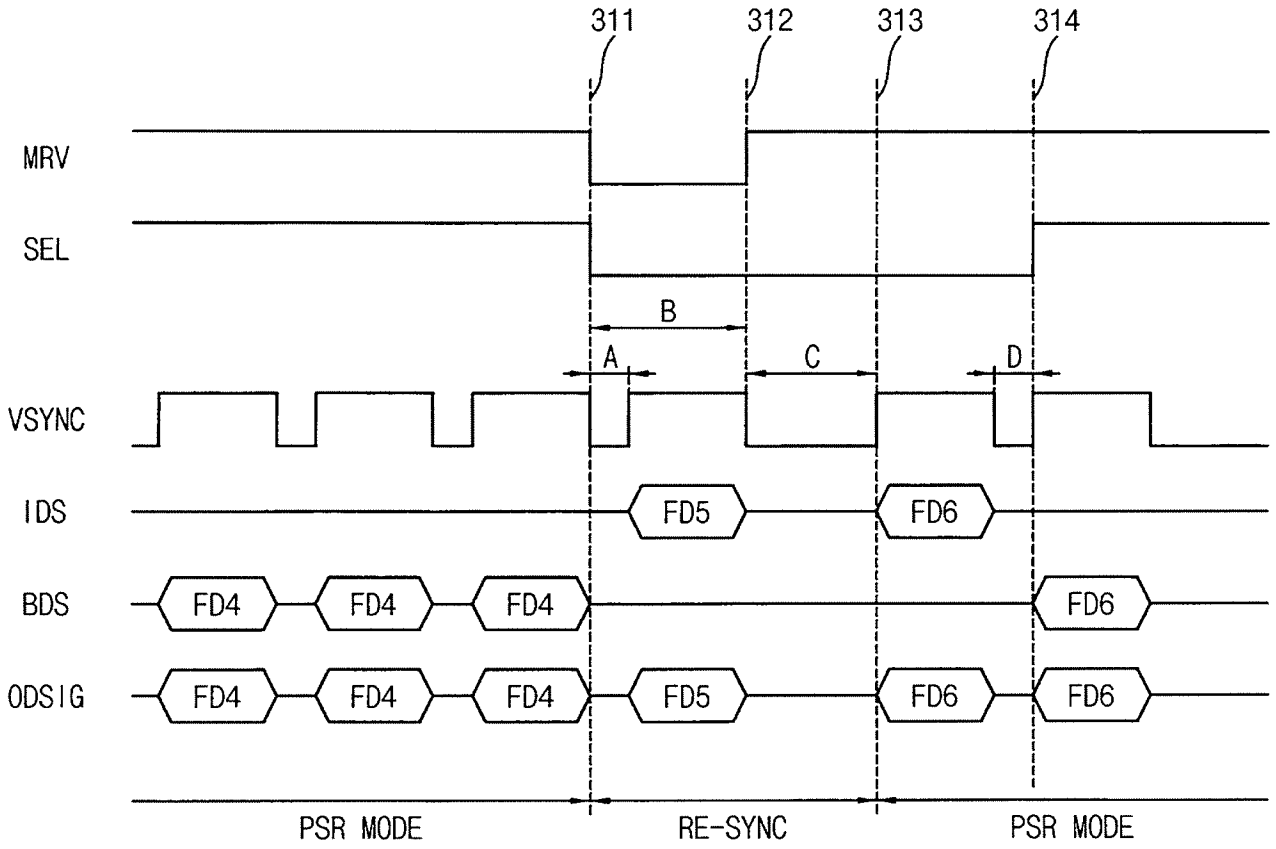

FIG. 7 shows a case where the operation mode of the timing controller 130 is changed again to the panel self-refresh mode PSR MODE while the operation mode of the timing controller 130 is changed from the panel self-refresh mode PSR MODE to the normal mode NORMAL MODE.

Operations before a first time point 311 may be understood based on the reference to FIG. 6.

Because the value MRV stored in the mode register MR is changed to a logic low value in response to the panel self-refresh end signal inputted to the timing controller 130 at the first time point 311, the timing controller 130 executes a synchronization procedure RE-SYNC from the first time point 311 to a third time point 313. The synchronization procedure RE-SYNC is a procedure changing the timing controller 130 so that the timing controller 130 generates the clock signal CLK and the output data signal ODSIG based on the input data signal DSIG when the operation mode of the timing controller 130 is changed from the panel self-refresh mode PSR MODE to the normal mode NORMAL MODE.

The panel self-refresh start command is inputted to the timing controller 130 at a second time point 312. If the panel self-refresh start command were not inputted at the second time point 312, the timing controller 130 would switch from the panel self-refresh mode PSR MODE to the normal mode after the synchronization procedure. However, the input of the panel self-refresh start command at the second time point 312 acts to interrupt this switch.

Because the value MRV stored in the mode register MR is changed to a logic high value in response to the panel self-refresh start command inputted to the timing controller 130 at the second time point 312, the timing controller 130 operates in the panel self-refresh mode PSR MODE after the third time point 313.

From the third time point 313 to a fourth time point 314, the receiver 131 generates a sixth frame data FD6 as the internal data signal IDS and the multiplexer MUX outputs the internal data signal IDS as the output data signal ODSIG. At the same time, the frame buffer FRAME BUFFER stores the sixth frame data FD6 through the internal data signal IDS. At the fourth time point 314, the selection signal generator SELGEN activates the selection signal SEL based on the value MRV stored in the mode register MR. After the fourth time point 314, the frame buffer FRAME BUFFER outputs the sixth frame data FD6 as the buffer data signal BDS and the multiplexer MUX outputs the buffer data signal BDS as the output data signal ODSIG.

The A period A is a vertical blank period per frame in the synchronization procedure RE-SYNC. The B period B is a display period per frame in the synchronization procedure RE-SYNC. The C period C is a first vertical blank period, which is between the second time point 312 and the third time point 313. In an exemplary embodiment, no image is displayed during period A and a frame of image data is displayed only during a portion of period B that excludes period A. The panel self-refresh start command is inputted to the timing controller 130 at the second time point 312. The synchronization procedure RE-SYNC ends at the third time point 313. The D period D is a vertical blank period per frame in the panel self-refresh mode PSR MODE. In an exemplary embodiment, when the panel self-refresh start command is input during a resynchronization period but prior to the end of the first vertical blank period, the PSR mode does not begin until the first vertical blank period has ended.

When the length of the first vertical blank period C is equal to or less than the length of the display period B per frame in the synchronization procedure, in an exemplary embodiment, the timing controller 130 maintains the luminance of the display panel 120 by maintaining the length of the first vertical blank period C. The synchronization procedure may occur for several periods of the vertical synchronization signal VSYNC. For example, if the synchronization procedure occurs for two periods of the vertical synchronization signal VSYNC, and a first length of the first vertical blank period C during the first of the two periods is equal to or less than a length of the display period B during the first of the two periods, a second length of the first vertical blank period C during the second of the two periods is the same as the first length.

Figure 8:
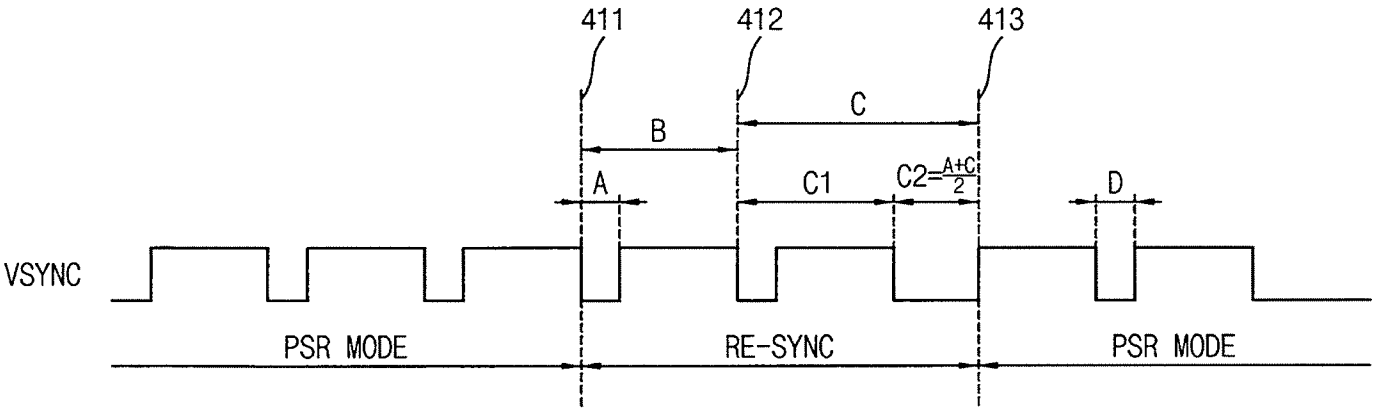

FIG. 8 is a timing diagram illustrating an exemplary embodiment of the vertical synchronization signal VSYNC of FIG. 7.

The panel self-refresh start command is inputted to the timing controller 130 at a second time point 412 which is within the synchronization procedure RE-SYNC 411~413.

When the length of the first vertical blank period C is larger than the length of the display period B per frame in the synchronization procedure, in an exemplary embodiment, the first vertical blank period C is divided into a first frame display period C1 and a remaining vertical blank period C2, where the first frame display period C1 has the same length as the display period B per frame in the synchronization procedure. In an exemplary embodiment, an image is displayed only during a portion of the first frame display period and no image is displayed during the remaining vertical blank period C2. The timing controller 130 generates the data driving circuit control signal DCS and the gate driving circuit control signal GCS in the first frame display period C1 in response to the input data signal DSIG. In an exemplary embodiment, the timing controller 130 changes the length of the remaining vertical blank period C2 to an average value ((A+C)/2) of the length of the vertical blank period (e.g., period A) per frame in the synchronization procedure and the length of the first vertical blank period C. For example, if the synchronization procedure occurs for two periods of the vertical synchronization signal VSYNC, and a first length of the first vertical blank period C during the first of the two periods is greater than a length of the display period B during the first of the two periods, during the second of the two periods, VSYNC has the display period B of the first period and then has a low period C2.

Figure 9:
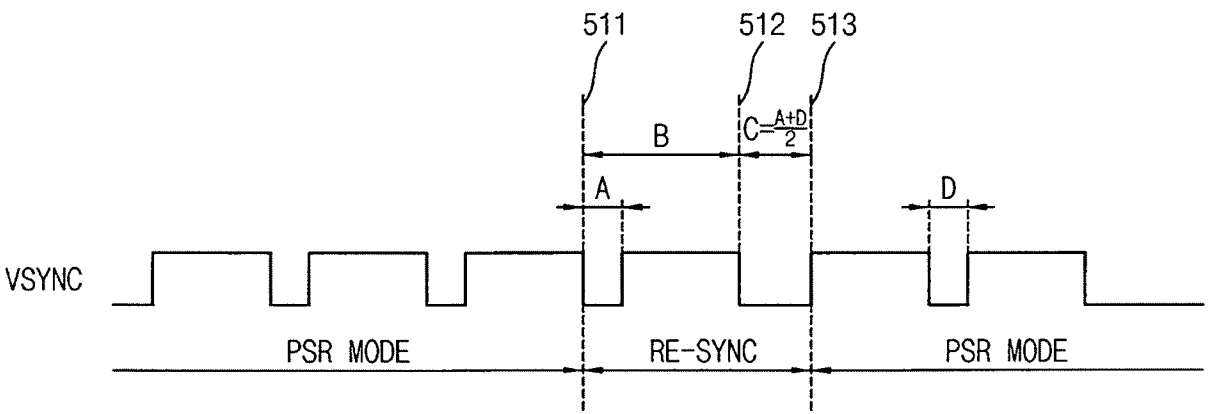

FIG. 9 is a timing diagram illustrating an exemplary embodiment of the vertical synchronization signal VSYNC of FIG. 7.

When the length of the first vertical block period C is equal to or less than the length of the display period per frame in the synchronization procedure B, in an exemplary embodiment, the timing controller 130 changes the length of the first vertical blank period C to an average value ((A+D)/2) of the length of the vertical blank period (e.g., period A) per frame in the synchronization procedure and the length of the vertical blank period (e.g., period D) per frame in the panel self-refresh mode.

Figure 10:
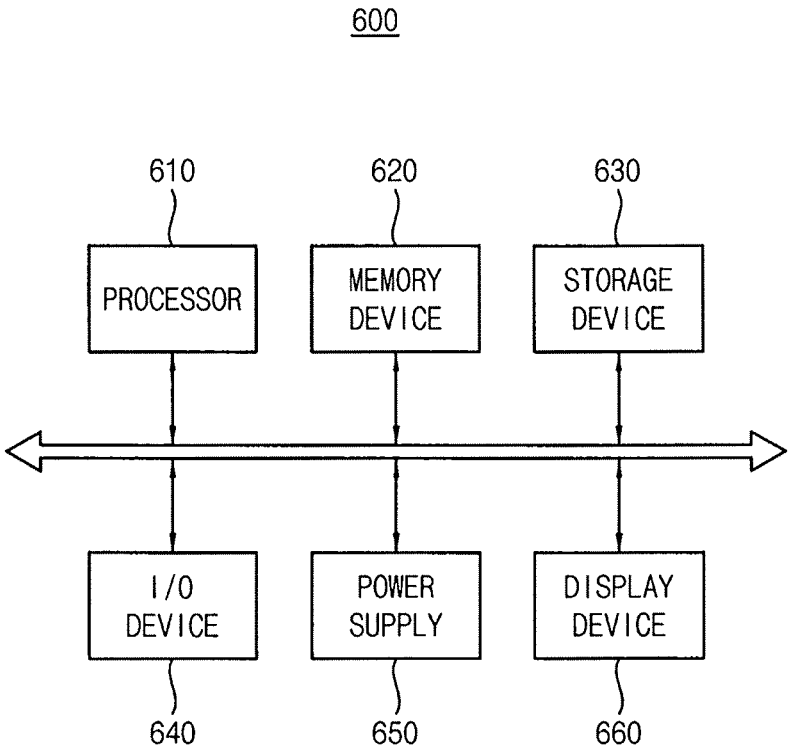
FIG. 10 is a block diagram illustrating an electronic device including a display device according to an exemplary embodiment of the inventive concept.

FIG. 10 is a block diagram illustrating an electronic device including a display device according to an exemplary embodiment of the inventive concept.

Referring to FIG. 10, an electronic device 600 includes a processor 610, a memory device 620, a storage device 630, an input/output (I/O) device 640, a power supply 650, and a display device 660. Here, the electronic device 600 may further include a plurality of ports for communicating with a video card, a sound card, a memory card, a universal serial bus (USB) device, other electronic devices, etc. Although it is illustrated in FIG. 10 that the electronic device 600 is implemented as a smart-phone, the type of the electronic device 600 is not limited thereto.

The processor 610 may perform various computing functions. The processor 610 may be a micro processor, a central processing unit (CPU), etc. The processor 610 may be coupled to other components via an address bus, a control bus, a data bus, etc. Further, the processor 610 may be coupled to an extended bus such as a peripheral component interconnection (PCI) bus.

The memory device 620 may store data for operations of the electronic device 600. For example, the memory device 620 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc.

The storage device 630 may be a solid state drive (SSD) device, a hard disk drive (HDD) device, a CD-ROM device, etc. The I/O device 640 may be an input device such as a keyboard, a keypad, a touchpad, a touch-screen, a mouse, etc., and an output device such as a printer, a speaker, etc. The power supply 650 may provide a power for operations of the electronic device 600. The display device 660 may communicate with other components via the buses or other communication links.

The display device 660 may be the display device 170 included in the display system 100 of FIG. 4. The display device 660 may be understood based on reference to FIGS. 1 through 9.

At least one exemplary embodiment of the inventive concept may be applied to any electronic system 600 having the display device 660. For example, at least one embodiment of the inventive concept may be applied to the electronic system 600, such as a digital or 3D television, a computer monitor, a home appliance, a laptop, a digital camera, a cellular phone, a smart phone, a personal digital assistant (PDA), a portable multimedia player (PMP), a MP3 player, a portable game console, a navigation system, a video phone, etc.

The foregoing is illustrative of the inventive concept and is not to be construed as limiting thereof. Although a few exemplary embodiments have been described, those skilled in the art will readily appreciate that many modifications are possible in the exemplary embodiments without materially departing from the inventive concept. Accordingly, all such modifications are intended to be included within the scope of this disclosure.

What is claimed is:

1. A method of operating a display device, the method comprising:

operating a timing controller in a panel self-refresh mode to generate a driving signal of a display panel based on stop image data stored in a frame buffer in response to a first panel self-refresh start command;

configuring the timing controller during a synchronization period to generate the driving signal for a normal mode based on an input data signal, in response to a panel self-refresh end command; and controlling a luminance of the display panel, by the timing controller, based on a length of a first vertical blank period starting at a first time point and ending at a second time point, when a second panel self-refresh start command is input to the timing controller at the first time point during the synchronization period, the synchronization period ending at the second time point.

2. The method of claim 1, wherein controlling the luminance of the display panel includes: generating the driving signal, by the timing controller, in a first frame display period in response to the input data signal when the length of the first vertical blank period is larger than a length of a display period per frame in the synchronization period, the first vertical blank period being divided into the first frame display period and a remaining vertical blank period, the first frame display period having the same length as the display period per frame in the synchronization.

3. The method of claim 2, wherein controlling the luminance of the display panel further includes: changing, by the timing controller, a length of the remaining vertical blank period to an average value of length of a vertical blank period per frame in the synchronization period and the length of the first vertical blank period when the length of the first vertical blank period is larger than the length of the display period per frame in the synchronization period.

4. The method of claim 1, wherein controlling the luminance of the display panel includes: maintaining, by the timing controller, the luminance of the display panel by maintaining the length of the first vertical blank period when the length of the first vertical blank period is equal to or less than a length of a display period per frame in the synchronization procedure.

5. The method of claim 1, wherein controlling the luminance of the display panel includes: changing, by the timing controller, the length of the first vertical blank period to an average value of length of a vertical blank period per frame in the synchronization period and length of a vertical blank period per frame in the panel self-refresh mode when the length of the first vertical block period is equal to or less than length of a display period per frame in the synchronization period.

6. The method of claim 1, wherein operating the timing controller in the panel self-refresh mode includes: storing image data of a frame, which is a first frame after the first panel self-refresh start command is inputted, as the stop image data to the frame buffer; and a generating the driving signal based on the stop image data stored in the frame buffer.

7. The method of claim 1, wherein the timing controller includes a receiver, wherein the receiver includes:

a command receiver configured to receive the first and second panel self-refresh start commands and the panel self-refresh end command as a command signal; and a data receiver configured to receive the input data signal.

8. The method of claim 7, wherein an application processor generates the first and second panel self-refresh start commands, the panel self-refresh end command, and the input data signal.

9. The method of claim 7, wherein the timing controller includes a mode register storing a first value corresponding to the normal mode or a second value corresponding to the panel self-refresh mode.

10. The method of claim 9, wherein the timing controller sets a value stored in the mode register as the first value in an initialization process.

11. The method of claim 9, wherein the timing controller sets a value stored in the mode register as the second value in response to the first or second panel self-refresh start command.

12. The method of claim 9, wherein the timing controller sets a value stored in the mode register as the first value in response to the panel self-refresh end command.

13. The method of claim 9, wherein the timing controller includes a clock signal generator configured to generate a clock signal, wherein the clock signal generator generates the clock signal based on the input data signal when a value stored in the mode register is the first value, wherein the clock signal generator generates the clock signal based on an output signal of an oscillator when the value stored in the mode register is the second value.

14. The method of claim 9, wherein the timing controller provides power to the data receiver when the value stored in the mode register is the first value.

15. The method of claim 9, wherein the timing controller cuts power to the data receiver when the value stored in the mode register is the second value.

16. A method of operating a display device, the method comprising:

a timing controller of the display device comparing a vertical blank period to a display period after receiving a first command to end a panel self-refresh mode followed by a second command to start the panel self-refresh mode;

the timing controller reducing the vertical blank period when a result of the comparing indicates the vertical blank period is greater than the display period; and the timing controller maintaining the vertical blank period when the result indicates the vertical blank period is less than or equal to the display period.

17. The method of claim 16, wherein the second command is received at a first time point, the timing controller performs a synchronization procedure that begins upon receipt of the first command and ends at a second time point after the first time point, and the compared vertical blank period is between the first and second time points.

18. The method of claim 17, wherein the reducing divides the vertical blank period into a frame display period and a remaining vertical blank period.

19. The method of claim 18, wherein the reducing generates a vertical synchronizing signal during the frame display period that toggles from a first logic state to a second logic state and that has the first logic state during the remaining vertical blank period.

20. The method of claim 18, wherein the reducing changes a length of the remaining vertical blank period to an average value of a length of a vertical blank period per frame in the synchronization procedure and length of a vertical blank period per frame in the panel self-refresh mode.

* * * * *